US006840011B2

(12) United States Patent
Thompson et al.

(10) Patent No.: US 6,840,011 B2
(45) Date of Patent: Jan. 11, 2005

(54) WINDOW PANEL BALANCE APPARATUS AND METHOD

(75) Inventors: Roy A. Thompson, Dorchester, MA (US); Douglas W. Kroncke, Boston, MA (US); John C. Costello, Wellesley, MA (US); David P. Chastain, Acton, MA (US); Jack D. Gundlach, Acton, MA (US); Timothy J. Kelley, Stillwater, MN (US); Larry Versteeg, Sioux Falls, SD (US); Thomas Hansel, Rockford, IL (US); Arthur R. King, IV, River Falls, WI (US); James R. Harger, Rockford, IL (US); Michael L. Doll, Osceola, WI (US); James L. Peterson, New Richmond, WI (US); Dennis A. Galowitz, Stillwater, MN (US); Richard M. Fischer, Stillwater, MN (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 10/149,181

(22) PCT Filed: Dec. 13, 2000

(86) PCT No.: PCT/US00/33789

§ 371 (c)(1),
(2), (4) Date: Oct. 24, 2002

(87) PCT Pub. No.: WO01/42605

PCT Pub. Date: Jun. 14, 2001

(65) Prior Publication Data

US 2003/0226317 A1 Dec. 11, 2003

Related U.S. Application Data

(60) Provisional application No. 60/170,307, filed on Dec. 13, 1999.

(51) Int. Cl.[7] ..... E05D 15/22
(52) U.S. Cl. ..... 49/181; 49/445
(58) Field of Search ..... 49/176, 181, 445, 49/446, 447; 16/196, 197, 198, 199

(56) References Cited

U.S. PATENT DOCUMENTS 2,262,990 A 11/1941 Cross et al.
2,952,884 A 9/1960 Dinmore (List continued on next page.)

FOREIGN PATENT DOCUMENTS

GB 2 276 655 10/1994

OTHER PUBLICATIONS

The 'Invisible' Balance for Custom Wood Windows, *SHELTER Magazine*, describing Strybuc Industries' concealed balance as being on the market since before Dec. 13, 1998, p. 37 (Jul. 2000).

(List continued on next page.)

*Primary Examiner*—Jerry Redman
(74) *Attorney, Agent, or Firm*—Womble Carlyle Sandridge & Rice, PLLC

(57) ABSTRACT

A window having a window panel that slides in a frame and at least one balancer that is secured to the window panel is disclosed. The window is of the tiltable hung type having a vertical operating position in which the balancer slides with the window panel in the frame and a tilted position in which the balancer remains secured to the window panel. The balancer includes an extensible member having a first end operatively coupled to the balancer and a second end operatively coupled to a frame so that the balancer can exert a force on the window panel to assist against the force of gravity when the window panel is in the vertical operating position. A method of constructing a tiltable hung window with a balancer secured to the window panel is also disclosed.

18 Claims, 7 Drawing Sheets

U.S. PATENT DOCUMENTS

| | | | | | |
|---|---|---|---|---|---|
| 3,054,152 | A | | 9/1962 | Trammell, Jr. | |
| 3,055,044 | A | | 9/1962 | Dinsmore | |
| 3,091,797 | A | | 6/1963 | Prosser | |
| 3,114,178 | A | | 12/1963 | Wood | |
| 3,147,517 | A | | 9/1964 | Dinsmore | |
| 3,358,403 | A | | 12/1967 | Dinsmore | |
| 3,676,956 | A | | 7/1972 | Taylor et al. | |
| 4,078,336 | A | | 3/1978 | Prosser | |
| 4,089,085 | A | | 5/1978 | Fitzgibbon | |
| 4,190,930 | A | | 3/1980 | Prosser | |
| 4,332,054 | A | * | 6/1982 | Paist et al. | 16/197 |
| 4,642,845 | A | * | 2/1987 | Marshik | 16/194 |
| 4,654,928 | A | | 4/1987 | Flight | |
| 4,675,948 | A | | 6/1987 | Bengtsson | |
| 4,704,821 | A | | 11/1987 | Berndt | |
| 4,718,194 | A | | 1/1988 | FitzGibbon et al. | |
| 4,724,577 | A | | 2/1988 | Langley | |
| 4,763,447 | A | | 8/1988 | Haltof et al. | |
| 4,949,425 | A | | 8/1990 | Dodson et al. | |
| 5,542,212 | A | | 8/1996 | Erickson et al. | |
| 5,544,450 | A | | 8/1996 | Schmidt et al. | |
| 5,615,452 | A | | 4/1997 | Habbersett | |
| 5,737,877 | A | | 4/1998 | Meunier et al. | |
| 5,784,840 | A | | 7/1998 | Dodson | |
| 5,873,199 | A | | 2/1999 | Meunier et al. | |
| 6,467,128 | B1 | * | 10/2002 | Damani | 16/197 |
| 6,622,342 | B1 | * | 9/2003 | Annes et al. | 16/197 |

OTHER PUBLICATIONS

Take Out System for Single/Double Hung Windows 100 Series brochure (color copy submitted, 6 pages) This balancer product is believed to have been sold since before Dec. 13, 1998.

Take Out System for Single/Double Hung Windows 400 Series brochure (color copy submitted, 6 pages) This balancer product is believed to have been sold since before Dec. 13, 1998.

Take Out System for Single/Double Hung Windows 650 Series brochure (color copy submitted, 6 pages) This balancer product is believed to have been sold since before Dec. 13, 1998.

* cited by examiner

WINDOW PANEL BALANCE APPARATUS AND METHOD

This application is being filed as a PCT International Patent Application in the name of Andersen Corporation, a U.S. national corporation and resident, (Applicant for all countries except US), Roy A. Thompson, a U.S. citizen (Applicant for US only), Douglas W. Kroncke a U.S. citizen (Applicant for US only), John C. Costello, a U.S. citizen (Applicant for US only), David P. Chastain, a U.S. citizen (Applicant for US only), Jack D. Gundlach, a U.S. citizen (Applicant for US only), Timothy J. Kelley, a U.S. citizen (Applicant for US only), Larry Versteeg, a U.S. citizen (Applicant for US only), Thomas Hansel, a U.S. citizen (Applicant for US only), Arthur R. King IV, a U.S. citizen (Applicant for US only), James R. Hager, a U.S. citizen (Applicant for US only), Michael L. Doll, a U.S. citizen (Applicant for US only), James L. Peterson, a U.S. citizen (Applicant for US only), Dennis A. Galowitz, a U.S. citizen (Applicant for US only), and Richard M. Fischer, a U.S. citizen (Applicant for US only) on 13, Dec. 2000, designating all countries.

FIELD OF THE INVENTION

This invention relates generally to tilting hung windows. More specifically, this invention relates to a tilting hung window having a balancer secured to the window panel.

BACKGROUND OF THE INVENTION

This invention relates generally to double and single hung windows. Specifically, this invention relates to balancers secured to the window panel.

Hung windows such as double and single hung windows typically include a balancer secured to the frame such that the balancer assists the sash against gravity. The balancer typically includes a spring which provides the lifting force. Many balancers also include a block and tackle assembly which provides a combination of the necessary internal friction and mechanical advantage such that a relatively limited change in the compression of the spring provides a much larger range of movement of the sash itself.

In the prior art, the balancer is located and secured in the jamb or jamb liner. Balancers in jamb liners cause jamb liners to be thick and complex in shape. Furthermore, the complex shape makes it difficult to appropriately color the jamb liner. The jamb/jamb liner combination must be disassembled to gain access to the balancer for service or replacement. When a window is replaced, it is sometimes necessary to install an additional jamb liner so that the balancer can be placed in the jamb liner. This added jamb liner takes space away from the clear glass area.

Many hung windows include a sash that can be tilted inward for ease of cleaning. Typically, the lower rail of the sash remains in the plane of the window while the top rail tilts inward. The sash typically pivots about a pivot mechanism that is a separate component from the balancer. This separate component requires additional assembly time when constructing the window.

On the tilting type hung windows, it is important to prevent the lower rail from vertical movement during cleaning or replacement. Different mechanisms have been used to "lock" the vertical position of the sash when in its tilted position. However, these prior art mechanisms are bulky and costly and are separate components that must be assembled to the window separately from the balancer. This separate assembly results in time consuming construction of the window.

SUMMARY OF THE DISCLOSURE

In accordance with this invention the above and other problems have been solved by a hung window having a frame, a window panel and a balancer secured to one of the sides of the window panel. The frame includes two oppositely disposed side members. The window panel includes two oppositely disposed sides such that the window panel is slidably mounted in the frame. The window panel has a vertical operating position and a tilted position. The balancer includes a housing, extensible member and latching mechanism. The housing is secured to the first side member of the window panel. The housing includes a pivot end about which the housing pivots when the window moves from its vertical position to its tilted position. The first end of the extensible member is operatively coupled to the balancer and the second end of the extensible member is operatively coupled to the first side member of the frame wherein the balancer exerts a force on the window panel through the extensible member in the direction substantially opposite the force of gravity when the window panel is in the vertical operating position. The latching mechanism communicates with the balancer to prevent the pivot end of the housing from moving vertically in the direction of gravity when the window panel is in the tilted position.

In accordance with another aspect of the invention, a spring loaded block and tackle balance assembly is provided. The spring loaded block and tackle assembly includes a housing having a first and second end and defining an elongated chamber. A pulley wheel is operatively coupled to the second end of the housing wherein the pulley wheel includes a first and second circumferential edge portions defining a groove there between. The block and tackle balance assembly includes a biasing member positioned in the elongated chamber. A block and tackle are located in the housing and are operatively coupled to each other and to the housing. The block and tackle include an extensible member that has two positions relative to the pulley wheel. The first position of the extensible member is in the groove of the pulley wheel. The extensible member is extensible when in the first position. The second position of the extensible member is between one of the first and second circumferential edge portions and a pinching member that is operatively coupled to the housing. The extensible member is not extensible when in the second position. The first position of the extensible member occurs when the window panel is in its vertical position within the frame. When the window panel is tilted from the vertical position to the tilted position the extensible member moves from the first position to the second position.

In accordance with another aspect of the invention, a balancer including a housing, an extensible member, a pulley wheel having a circumferential portion, a brake and a rotatable cam member is disclosed. The extensible member passes partially around the circumferential portion of the pulley wheel. The brake includes a braking surface adjacent the extensible member and an oppositely disposed force receiving surface. The brake has a locked position and an unlocked position. In the unlocked position the braking surface is not in forceful contact with the extensible member. In the locked position the brake is in contact with the extensible member such as to compress the extensible member between the circumferential portion of the pulley wheel and the braking surface. The rotatable cam includes a camming surface that when rotated contacts the force receiving surface of the brake forcing the brake into the locked position.

In accordance with another aspect of the invention, a balancer for a hung window is provided. The balancer includes a housing, extensible member, rotatable block and pulley wheel. The housing includes a first pinching surface defining an opening. The extensible member includes a first end connected to the housing. The rotatable block is rotationally coupled to the housing and includes a second pinching surface substantially parallel to the first pinching surface. The rotatable block is configured to communicate with a frame side member such that tilting of the housing relative to the frame side member results in rotation of the rotatable block relative to the housing along an axis perpendicular to the first and second pinching surfaces. The pulley wheel is rotatably coupled to the rotatable block. The extensible member passes through the opening in the first pinching surface and partially around the circumferential surface of the pulley wheel. When the balancer is in a vertical upright position, the opening in the first pinching surface and the circumferential portion of the pulley wheel are aligned to allow the movement of the extensible member there through. When the balancer is in a tilted non-vertical position relative to an associated window frame, the rotatable block rotates to place the opening and the pulley wheel out of alignment such that longitudinal movement of the extensible member is prevented.

In accordance with another aspect of the invention a balancer having a housing, extensible member, pivot pin, pulley wheel and rotatable pinching member is provided.

In accordance with another aspect of the invention, a balance, pin and latch mechanism for attachment to a window panel is provided. The mechanism includes balance means for applying force to the window panel. The mechanism also includes a pivot pin connected to balance means such that the window panel can be pivoted about the pivot pin. A latch means is also provided for preventing vertical motion of the window panel when in its tilted position. The latch means is also connected to balance means.

In accordance with another aspect of the invention, a method of constructing a hung window is provided. The method includes building a frame, obtaining a window panel and securing a pair of balancers to respective sides of the window panel. The balancers include an extensible member. The method also includes the step of coupling the extensible member to the frame wherein the pair of balancers bias the window panel in a direction substantially opposite the force of gravity when the window panel is in the vertical untilted position.

DETAILED DESCRIPTION

In the following description of preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the preferred embodiments of the present invention.

Figure 1:
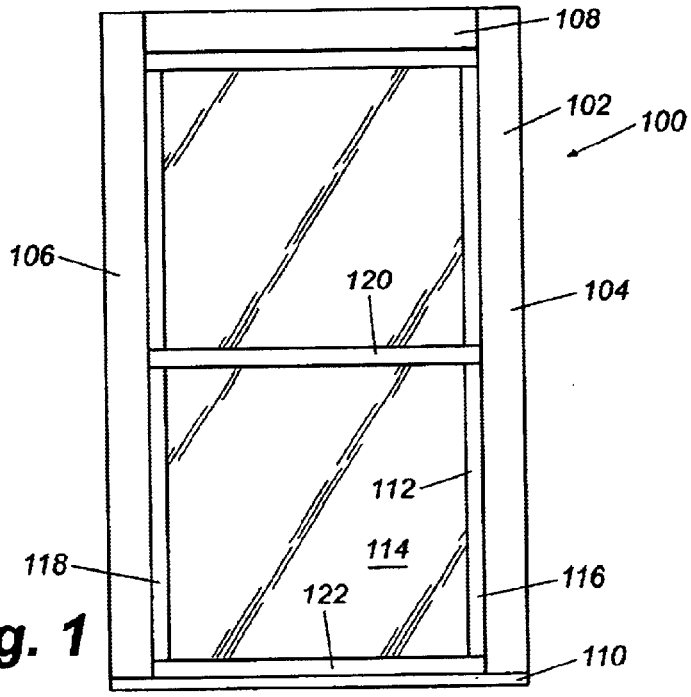
FIG. 1 is front view of a hung window in accordance with the principles of the invention.

FIG. 1 is a front view of a hung window 100 of this invention. The window 100 includes a frame 102 having oppositely disposed side members 104 and 106. The frame 102 also has a top member 108 and a bottom member 110. A sash 112 supports a window panel 114. The sash 112 has two oppositely disposed sides 116 and 118 parallel to the frame side members 104 and 106. The sash also includes a top rail 120 and a bottom rail 122.

Figure 2:
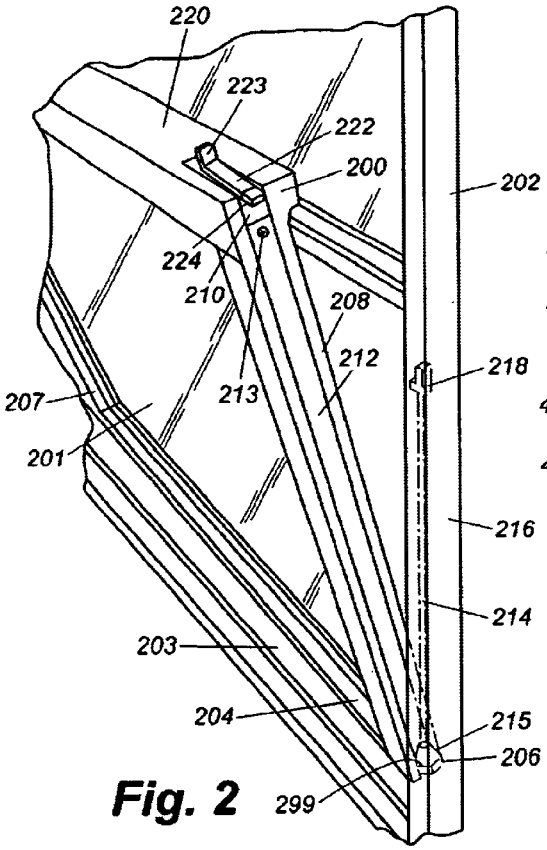
FIG. 2 is a perspective view of a portion of a hung window of a first embodiment in accordance with the principles of the invention.

FIG. 2 illustrates a preferred embodiment of the invention in which a sash 200 that supports a window panel 201 is shown in a tilted position with respect to the frame 202. A balancer 208 is secured to the sash side 212 by a screw 213. The balancer 208 is preferably positioned within a groove 210 in the sash side 212. The sash 200 is tilted along an axis substantially along the bottom rail 204. A first pivot pin 206 and a second pivot pin (not shown) provide the tilting mechanism. The pivot pin preferably slides in a groove in a jamb liner (not shown in FIG. 2) but it could also slide directly in the frame. The second pivot pin is positioned opposite the first pivot pin 206 on the side 207. The first pivot pin is operatively coupled to the balancer 208. The balancer 208 is further secured to the sash side 212 by a screw or other fastener through hole 215 in the pivot pin 206. Alternatively, the balancer 208 may be secured to the sash side 212 by a snap mechanism.

A balancer includes a pivot end. A pivot end is an end of a balancer around which the remainder of the balancer pivots when the balancer and its associated window panel rotate from a vertical operating position to a tilted position. One embodiment of a pivot end is pivot end 299 shown in FIGS. 2 and 4.

A second pivot pin (not shown) is coupled to a second balancer (not shown). The second balancer (not shown) is secured to the sash side 207 symmetrically to the way first balancer 208 is secured to sash side 212. Since the structure and operation of the second balancer is symmetric to the first balancer 208, this discussion is limited to the first balancer 208.

An extensible member such as a cord 214 or a chain, cable or other member that is extensible extends from the first balancer 208 at a location near the bottom rail 204. The portion of the cord 214 outside the balancer 208 extends substantially parallel to the frame side member 216 and is secured to the frame side member 216 by an anchor 218. The anchor 218 is preferably located in the same groove of the jamb liner or frame side member as the pivot pin 206 slides in. The anchor 218 may be a block that is attached to the side member 216 with a screw or other fastener. The cord 214 is held in the anchor 218 by being knotted on the opposite side of a hole in the anchor 218.

The balancer 208, secured to the sash 200, in conjunction with the cord 214 and its anchor 218 applies a biasing force to the sash 200 in an upward direction against the direction of gravitational acceleration. This biasing force augments the force applied by a user of the window in lifting the sash 200 upward in the frame 202 when the window panel is in the vertical untilted position.

In a preferred embodiment of the invention the sash may be tilted from a vertical position to a tilted position. When it is desired to tilt the sash 200, the top rail 220 is disengaged from the frame 202 or jamb liner (not shown) by operation of the lever 222 and its symmetrical counterpart (not shown) located on the opposite end of the top rail 220. When the sash 200 is in its vertical position, the lever end 224 is positioned in the same groove of the jamb liner or frame side member as is located the anchor 218. In this position the top rail 220 cannot be pulled away from the plane of the frame 202. By lifting the lever handle 223 up and away from the top rail 220, the lever end 224 is rotated downward such that the lever end 224 becomes positioned within the groove 210. When the lever end 224 is so positioned in the groove 210, the top of the sash 200 including the top rail 220 can be tilted from its vertical position to its tilted position as shown in FIG. 2. Note that as positioned in FIG. 2 the lever handle 223 is substantially down near the surface of the top rail 220 and hence the lever end 224 is not located in the groove 210. This position of the lever is the position that would be associated with the untilted or vertical position of the sash 200.

Figure 3:
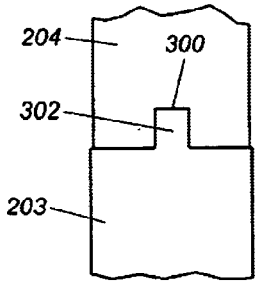
FIG. 3 is a side sectional view of a bottom rail of a sash and its interaction with the frame bottom member.

FIG. 3 illustrates a cross section of one embodiment of the bottom rail 204 and its interaction with the bottom member 203 of the frame when the sash 200 is in its vertical position. As shown in FIG. 3 the bottom rail 204 of the sash 200 defines a groove 300 that is substantially an upside down U shape. The bottom member 203 of the frame 202 has a U shaped extension 302 that mates with the groove 300. When the sash 200 is at its lowest vertical position in the frame 202, the extension 302 is mated with the groove 300 for insulation and other purposes. It is important that the person operating the window not be allowed to tilt the sash 200 when the extension 302 is mated into the groove 300 because tilting in this position would result in the extension 302 or part of the bottom rail 204 being broken. To avoid this problem, a preferred embodiment of the present invention requires placement of the anchor 218 in a specific vertical location on the frame side member 216. The general idea is to place the anchor 218 in such a position that when the extension 302 is mated even partially with the groove 300, the lever end 224 cannot be rotated into the groove 210 because the lever end 224 physically contacts the anchor 218. The user must lift the sash 200 vertically upward until the lever end 224 can be rotated into groove 210 without interference by the anchor 218. The anchor is vertically positioned such that the distance the sash 200 must be lifted corresponds with the vertical distance required to remove the extension 302 from the groove 300 sufficiently such that the sash can be tilted without interference between the extension 302 and the sash bottom rail 204.

Figure 4:
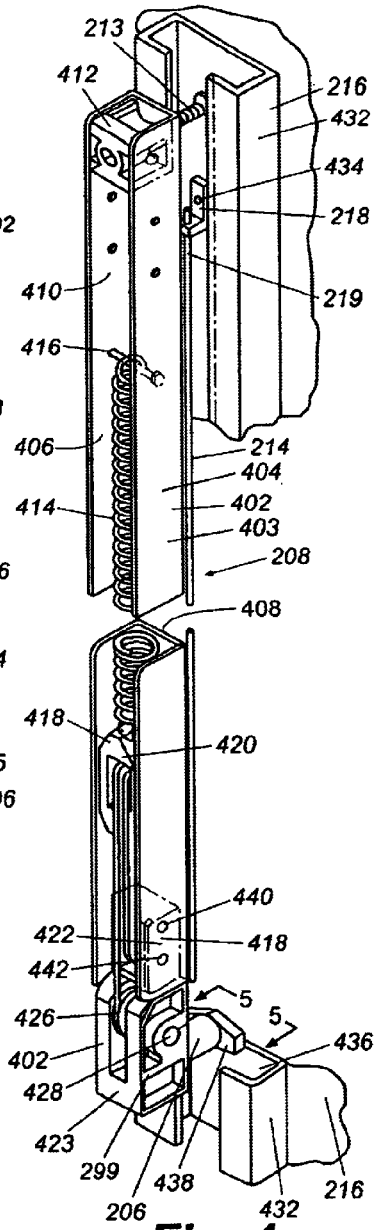
FIG. 4 is a perspective view of a balancer and a portion of a jamb liner and frame of a first embodiment in accordance with the principles of the invention.

FIG. 4 is a perspective view of a preferred embodiment of a balancer 208 of this invention. A balancer is defined as being any mechanism that provides a biasing force to a window sash. The balancer could be a spring biased block and tackle mechanism or it could be some other mechanism such as a weight and pulley system. While the preferred embodiments of this invention relate to a spring biased block and tackle mechanism, this invention is not so limited.

A housing is any structural member that supports the elements of a balancer. A housing may be made of steel or other materials including plastic. A housing may have multiple components or it may be one integral piece. A housing may include a housing extension which may be a separate member secured to the main part of the housing.

In a preferred embodiment, the balancer 208 includes a housing 402 that includes an elongated U-shaped housing 403 and a housing extension 423 attached to one end of the elongated U-shaped housing 403. The elongated U-shaped housing 403 is made of steel having a pair of parallel, laterally spaced sidewalls 404 and 406 and an outer wall 408 interconnecting the side walls 404 and 406 together. The elongated U-shaped housing 403 defines an elongated chamber 410. The housing 402 is secured to a side of sash such as sash 200 by means of screw 213 which is held in place by fastening block 412 which in turn is fastened to the housing 402 by a press fit. The housing extension 423 can be made of any structural material including steel and plastic.

A coil spring 414 has an anchored end connected to a pin 416 by a hook that hooks around the pin 416. The pin 416 is riveted or otherwise fastened to the side walls 404 and 406 of the housing 402. The opposite end of the spring 414 is connected to a block and tackle 418. The block and tackle 418 includes a first pulley member 420 and a second pulley member 422 that are conventionally interconnected by a cord 214 that passes back and forth between the two pulley members. The cord has a first end that is connected to the block and tackle 418. The cord 420 exits the block and tackle 418 by extending around the circumference of a pulley wheel 426 that is adjacent second pulley member 422. In a preferred embodiment of the invention, the pulley wheel 426 is slightly elliptical in shape. Preferably, pulley wheel 426 is supported at its axis by a pin 428 that is supported by housing extension 423 that is integral with second pulley member 422. The pulley wheel 426 changes the direction of the cord 214 by approximately 180 degrees. After this 180 degree turn, the cord extends parallel to the balancer 208 and a second end 219 of the cord 214 is anchored to the frame side member 216. The cord 214 is anchored to the frame side member 216 by attaching the cord 214 to anchor 218 as described above and then screwing the anchor 218 through the jamb liner 432 and into the frame side member 216 with screw 434.

The pin 206 is made of plastic and is an integral part of the housing extension 423 and second pulley member 422. During normal vertical up and down movement of the sash in the frame, the pin 206 slides up and down with the sash in the groove 436 of the jamb liner 432. The large head 438 on the pin 206 prevents the pin from being removed from the groove 436. When the sash is tilted out of the plane of the frame, the tilt axis is along the line between the pin 206 and its counterpart pin (not shown) located on the opposite side of the sash near the bottom rail. The housing extension 423 which is integral with the pin 206 is attached to the housing 402 by rivet pins 440 and 442 that extend through the second pulley member 422.

A latching mechanism is a component of a balancer, which operates to prevent a pivot end of a balancer from moving in a vertical downward direction when the window panel to which the balancer is attached is in a tilted position relative to the frame side members. Various embodiments of latching mechanisms are provided below. However, the scope of this invention is not limited to the specific embodiments provided. Other latching mechanisms including commercially available mechanisms may be used.

Figure 6:
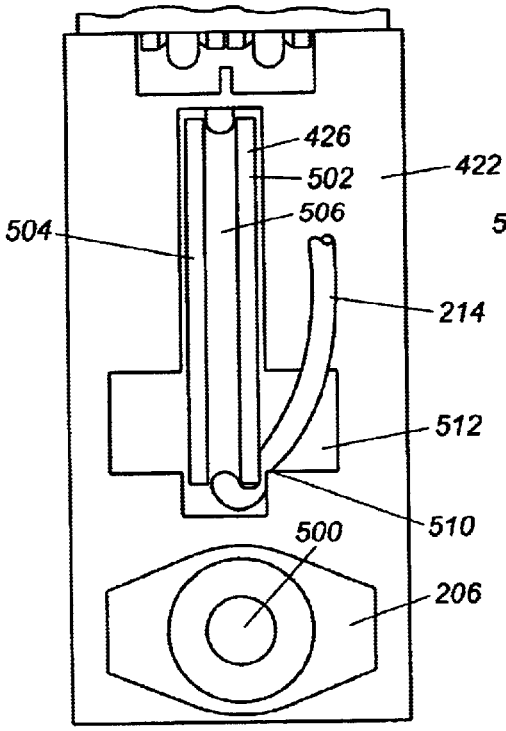
FIG. 6 is a side sectional view of a latching mechanism of a first embodiment in accordance with the principles of the invention.
Figure 5:
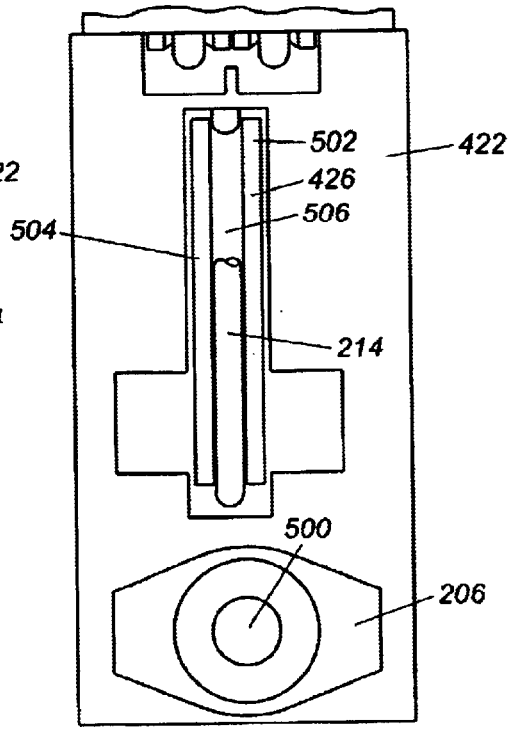
FIG. 5 is a side sectional view of a latching mechanism of a balancer of a first embodiment in accordance with the principles of the invention.

One embodiment of a latching mechanism is shown in FIGS. 5 and 6 taken along the line 5—5 of FIG. 4. FIG. 5 illustrates the unlocked position of the cord 214 with respect to pulley wheel 426 and housing extension 423 that occurs when the sash 200 is in a vertical untilted position. Note that housing extension 423 is part of the housing 402. FIG. 6 illustrates a locked position of the cord 214 with respect to the pulley wheel 426 and the housing extension 423 that occurs when the sash 200 is in its tilted position.

As can be seen in both FIGS. 5 and 6, the pulley wheel has a first and second circumferential edge portions 502 and 504 and a groove 506 between them. These circumferential edge portions have a larger radius than the groove 506. As shown in FIG. 5, when the sash is in its vertical position the cord 214 rides in the groove 506 and because of the circumferential edge portions 502 and 504 cannot be displaced out of the groove 506. When the sash is in its vertical position, the cord 214 is extensible such that it may freely be drawn and withdrawn during rotation of pulley wheel 426 as the window panel is moved vertically.

In FIG. 6 the cord 214 is pinched or caught between the circumferential edge portion 502 and the housing extension 423. Tilting the sash 200 relative to the frame causes this position of the cord 214 shown in FIG. 6. The second end 219 of the cord 214 is anchored to the frame and so the tilting action pulls the cord 214 out of the groove 506 and into a position in which it is between the pulley wheel and the housing extension 423. In the position shown in FIG. 6, the cord may not be extended in or out of the pulley wheel because the cord 214 is frictionally engaged between the pulley wheel 426 and the pinch point 510. The housing extension 423 is preferably shaped as shown in FIGS. 5 and 6. The housing extension 423 includes a right-angled pinch point 510 and a recess 512. The recess 512 is located closer to the axis of the pulley wheel 426 than is the pinch point 510. When the sash is tilted, the cord 214 is pulled into the recess 512 and necessarily between the circumferential edge portion 502 of the pulley wheel 426 and the pinch point 510.

A preferred embodiment of the circumferential edge portions discussed throughout the various embodiments of the invention is chamfered or rounded so that damage to the extensible member is minimized when the extensible member is pinched against a circumferential edge portion. Such a chamfered or rounded edge is shown in the drawing figures.

The latching mechanisms shown in FIGS. 7-23 may be utilized within the same window construction as discussed above with respect to FIGS. 1-4. The latching mechanisms shown in FIGS. 7-23 are possible replacements for the latching mechanism identified in FIGS. 5-6. The remaining portion of the balancers not shown in FIGS. 7-23 is the same as those balancer portions as described above with regard to both general concepts and specific embodiments.

Figure 7:
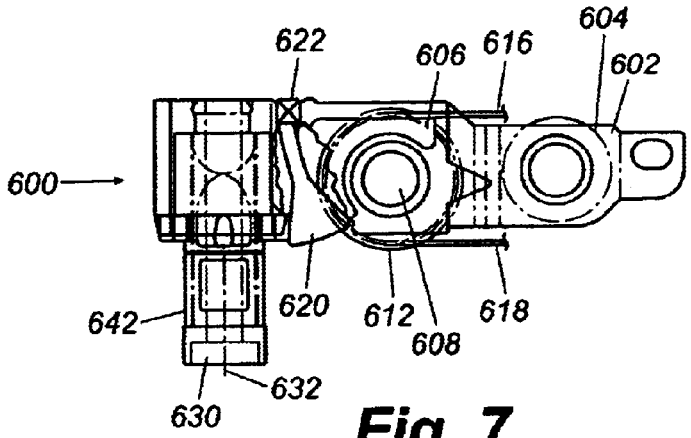
FIG. 7 is a front sectional view of a latching mechanism of a balancer of a second embodiment in accordance with the principles of the invention.
Figure 8:
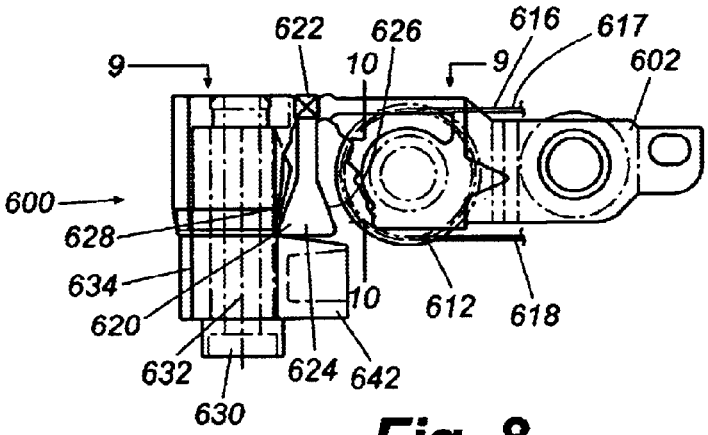
FIG. 8 is a front sectional view of a latching mechanism of a balancer of a second embodiment in accordance with the principles of the invention.
Figure 9:
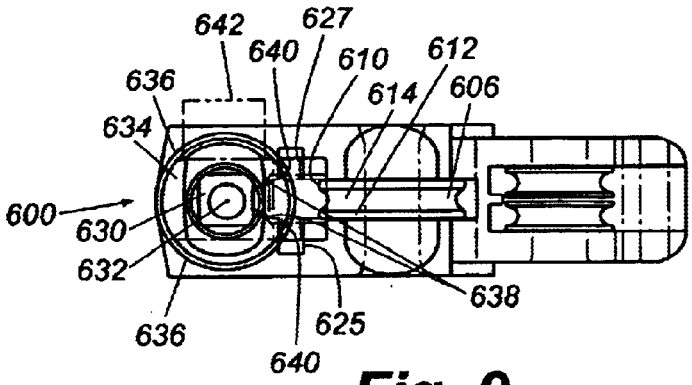
FIG. 9 is a side sectional view of latching mechanism of a balancer of a second embodiment in accordance with the principles of the invention.

One embodiment of a latching mechanism of a balancer is shown in FIGS. 7-9. Specifically a portion of balancer 600 is provided. As described above, the portions of balancer 600 not shown in FIGS. 7-9 would be the same as described above and shown in FIGS. 1-4. FIGS. 7 and 8 are side views with a portion of the housing extension cut away so that the underlying brake can be seen. FIG. 9 is a rear sectional view taken along lines 9—9 of FIG. 8.

The balancer 600 shown in FIGS. 7-9 includes a housing 602 that includes an elongated U-shaped housing (not shown but the same as described above and shown in FIGS. 1-4) and a housing extension 604. Balancer 600 includes a pulley wheel 606 that is rotatably coupled to housing extension 604 by axis 608. Pulley wheel 606 includes a first circumferential edge portion 610 and a second circumferential edge portion 612. The portion of the outer circumference of the pulley wheel 606 between the circumferential edge portions 610 and 612 is referred to as the circumferential portion 614. It should be noted that a circumferential portion might in general be any shape that will accommodate passage of an extensible member around the circumferential portion. Circumferential portion 614 is but one embodiment of a circumferential portion.

Extensible member 616 is centered on the circumferential portion 614 between the first and second circumferential edge portions 610 and 612 as it wraps around the pulley wheel 606. End 618 of the extensible member is configured to be secured to a frame side member as described above with respect to earlier embodiments. End 617 of the extensible member 616 continues to be utilized by the block and tackle also as described above with respect to earlier embodiments.

A brake is any member having a braking surface wherein the braking surface is configured so that when forceful contact is made between the braking surface and the extensible member supported by a pulley wheel, longitudinal movement of the extensible member is prevented. A brake may be stationary such that the extensible member and pulley wheel move toward and away from the stationary brake. Alternatively, the brake may move.

FIGS. 7 and 8 illustrate one embodiment of a brake, namely brake 620. Brake 620 includes an anchored end 622 and an oppositely disposed braking end 624. Anchored end 622 is nonrotatably secured to housing extension 604. Braking end 624 includes a braking surface 626 and a force-receiving surface 628. A braking surface is any surface which when forcefully made to contact an extensible member is configured to prevent longitudinal movement of the extensible member because of frictional contact and/or pinching of the extensible member between the braking surface and another member. The braking surface 626 is rounded to a radius that approximates the radius of the circumferential portion 614 of the pulley wheel 606. This shaping of the braking surface to match the shape of the pulley wheel increases the surface area of contact between the braking surface and the extensible member.

Balancer 600 includes a pivot pin 630 that is the same as pivot pin 206 except that pivot pin 630 is made of steel. Pivot pin 630 performs the same function as pivot pin 206.

A camming surface is any surface that rotates about an axis and which has at least one point of varying distance from the axis. A rotatable cam member is a rotatable member that includes a camming surface configured to contact a brake upon rotation of the rotatable cam member.

Rotatable cam member 634 shown in FIG. 9 is one embodiment of a rotatable cam member. Pivot pin 630 provides an axis 632 about which rotatable cam member 634 rotates. Rotatable cam member 634 includes a circular section 636 that travels less than the full circumference of the cam member 634. The radius from circular section 636 to the axis 632 is constant. Rotatable cam member 634 also includes a notch defined by a recessed edge 638. A recessed edge is an edge comprising points that are a shorter distance to the axis of rotation than the circular section. The transition from the recessed edge 638 to the circular edge 636 is a smooth transition to provide camming surface 640.

Note that many alternative designs for a rotatable cam member and its associated camming surface are possible. For example, a rotatable cam member could be a generally circular member with a bulge or bump along which the radius or distance from the outer edge of the rotatable cam member to the axis of rotation is greater than along the generally circular portion. Many other shapes for the camming surface are possible.

Rotatable cam member 634 includes transferring end 642, which is designed to be slidably received by a jamb liner channel. If a window panel secured to this embodiment of a balancer is moved from its vertical operating position to a tilted position, the sides of the jamb liner channel will prevent the transferring end 642, and hence the rotatable cam member 634, from tilting with the window panel thereby causing rotation of the rotatable cam member relative to and about the pivot pin 630.

FIG. 8 shows the positioning of the brake 620 and other elements of the balancer 600 when the associated window panel is in its vertical operating position. As shown in FIG. 8, the notch formed by the recessed edge 638 is aligned with the brake 620. In this vertical operating position, there is a gap between the braking surface 626 and the extensible member 616. As the window panel is moved from its vertical operating position to the tilted position, the camming surface 640 comes into forceful contact with the force-receiving surface 628 of the brake 620. The force applied by the rotatable cam member 634 onto the brake 620 causes the brake to flex in the direction of the extensible member 616 and the pulley wheel 606. Continued tilting of the window panel eventually results in the braking surface of the brake 620 forcefully pressing the extensible member against the circumferential portion 614 of the pulley wheel 606. Such pressure on the extensible member prevents longitudinal movement of the extensible member 616 and hence prevents the window panel from dropping downward by the force of gravity or by the force of any washing action on the window panel. FIG. 7 illustrates brake 620 in forceful contact with extensible member 616 as would be seen when the window panel is in its tilted position.

Figure 10:
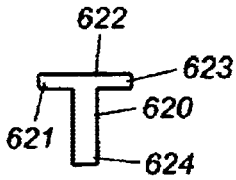
FIG. 10 is a top sectional view of a brake of a second embodiment in accordance with the principles of the invention.

FIG. 10 is a sectional view of brake 620 taken along lines 10—10 in FIG. 8. Brake 620 is generally T-shaped having ends 621 and 623. The ends 621 and 623 are designed to be inserted into receiving slots 625 and 627 in the housing extension 604 shown in FIG. 9.

Figure 11:
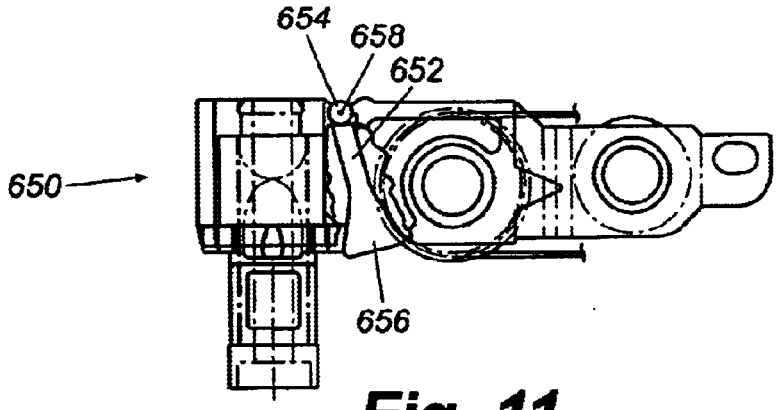
FIG. 11 is a front sectional view of a latching mechanism of a balancer of a third embodiment in accordance with the principles of the invention.
Figure 12:
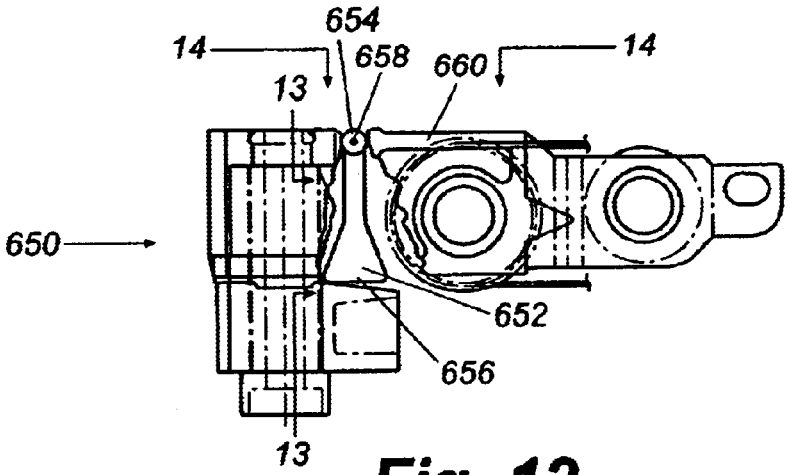
FIG. 12 is a front sectional view of a latching mechanism of a balancer of a third embodiment in accordance with the principles of the invention.

Turning now to FIGS. 11 and 12, another embodiment of a latching mechanism for a balancer is provided. Balancer 650 is the same as balancer 600 except that the brake utilized in balancer 650 has a rotational end instead of an anchored end. A rotational end is an end of a brake designed and positioned so that it can pivot about an axis. Brake 652 includes a rotational end 654 and a braking end 656. Braking end 656 is the same as braking end 624 of the embodiment shown in FIGS. 7-9. Rotational end 654 is not anchored, as was anchored end 622 in FIGS. 7-9. Rotational end 654 is designed to rotate about axis 658.

Operation of brake 652 is similar to brake 620 except that brake 652 rotates around axis 658 instead of flexing along the length of the brake when the rotatable cam member presses on the brake.

Figure 13:
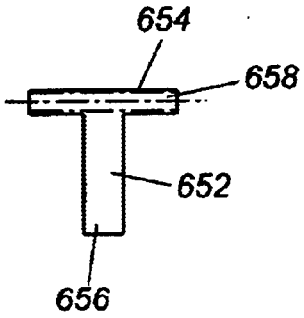
FIG. 13 is a top sectional view of a brake of a third embodiment in accordance with the principles of the invention.

FIG. 13 is a sectional view of brake 652 taken along lines 13—13 in FIG. 12. As can be seen in FIG. 13, brake 652 in this view is T-shaped.

Figure 14:
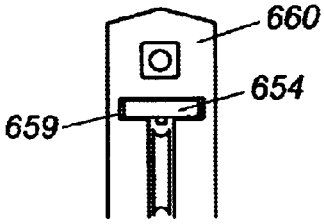
FIG. 14 is a side sectional view of a housing of a third embodiment in accordance with the principles of the invention.

FIG. 14 is a portion of the balancer 650 taken along lines 14—14 in FIG. 12. Rotational end 654 of brake 652 can be seen positioned in a slot formed by slot edge 659 in housing extension 660.

FIGS. 15-18 illustrate another embodiment of a balancer. FIGS. 15-18 do not show the entire balancer but rather components of the balancer. Components of the balancer not shown in FIGS. 15-18 are the same as shown in the earlier discussed embodiments.

Figure 15:
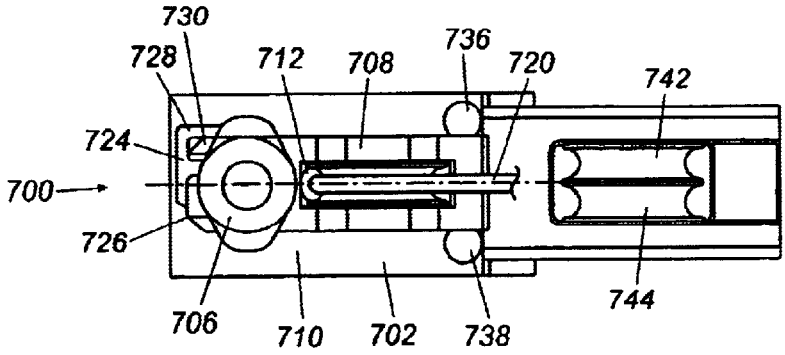
FIG. 15 is a side sectional view of a latching mechanism of a balancer of a fourth embodiment in accordance with the principles of the invention.
Figure 16:
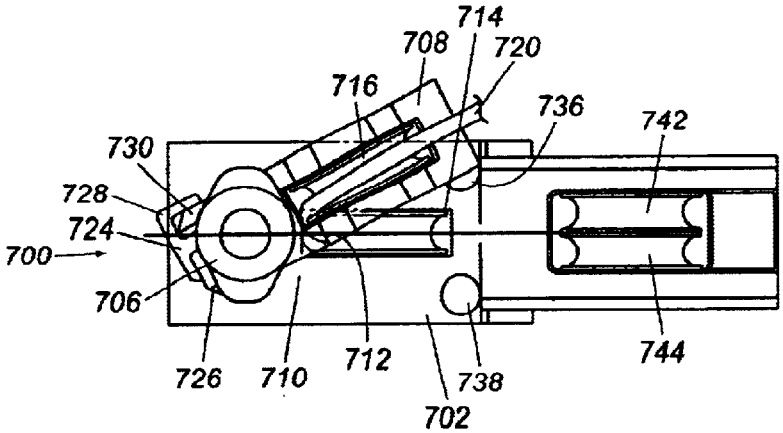
FIG. 16 is a side sectional view of a latching mechanism of a balancer of a fourth embodiment in accordance with the principles of the invention.

FIGS. 15 and 16 are sectional views as would be viewed from an adjacent frame side member when the balancer is secured to a window panel. Balancer 700 includes housing extension 702 configured with an opening 704 for receipt of a rivet for attaching housing extension 702 to an elongated U-shaped housing (not shown).

A pivot pin 706 is integrally connected to housing extension 702. Pivot pin 706 is configured for sliding interaction with a channel in a frame jamb liner that would be adjacent to the balancer.

A rotatable block is a rotatable member configured to rotate about a pivot pin when a window panel to which the associated balancer is attached is moved from a vertical operating position to a tilted position or vice versa. Rotatable block 708 is one embodiment of a rotatable block. Rotatable block 708 rotates about pivot pin 706. In its normal operating position, rotatable block 708 is situated in a groove of a jamb liner such as groove 436 in FIG. 4. Therefore, as the window panel is moved from its vertical operating position to its tilted position, rotatable block 708 rotates about pivot pin 706 relative to housing extension 702. FIG. 15 shows rotatable block 708 in the position associated with the vertical operating position of the window panel and balancer. FIG. 16 illustrates the position of the rotatable block 708 when the window panel and balancer are in a tilted position.

A pinching surface is any surface capable of compressing or pinching an extensible member between itself and another member. Housing extension 702 includes one embodiment of a pinching surface, specifically first pinching surface 710. First pinching surface 710 is a planar surface.

Housing extension 702 is shown with a cutaway view in FIG. 16 to show the positioning of pulley wheel 714. Housing extension 702 defines an opening 712 for passage of the extensible member 720 there through. Pulley wheel 714 receives the extensible member from the block and tackle (not shown). Extensible member passes partially around pulley wheel 714 and through the opening 712 and around pulley wheel 716 that is rotationally mounted to the rotatable block 708. As can be seen in FIG. 15, the opening 712 in extension housing 702 is aligned with pulley wheel 716 when the rotatable block is aligned with the housing extension 702. In FIG. 16, the rotation of rotatable block 708 causes the circumferential portion 718 of the pulley wheel 716 to move out of alignment with the opening 712.

Figure 17:
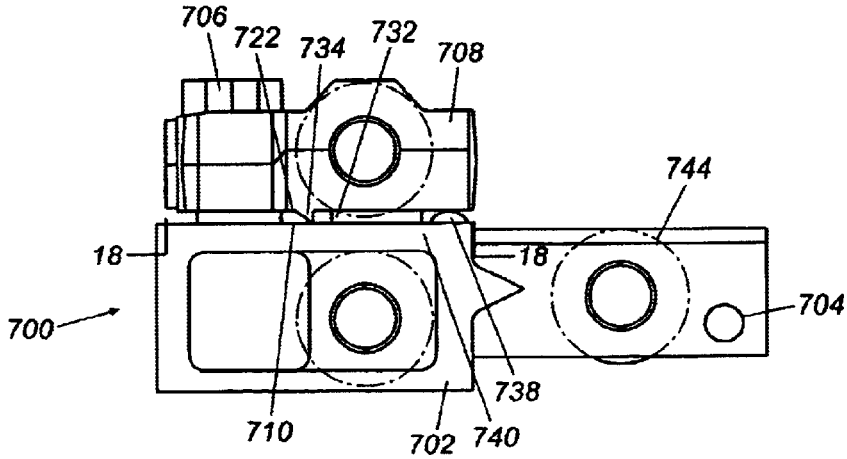
FIG. 17 is a front sectional view of a latching mechanism of a balancer of a fourth embodiment in accordance with the principles of the invention.

Rotatable block 708 includes a second pinching surface 722 as shown in FIG. 17. As rotatable block 708 moves into a position in which it is not aligned with the housing extension as shown in FIG. 16, extensible member 720 is pressed or pinched between the first pinching surface 710 and the second pinching surface 722. The pinching of extensible member 720 between the first and second pinching surfaces 710 and 722 when the balancer 700 is in the tilted position prevents the extensible member 720 from longitudinal movement which prevents the pivot pin 706 and the connected window panel from moving downward in the direction of gravity during tilting of the window panel and balancer.

Rotatable block 708 includes hinge clasp 724. Hinge clasp 724 allows for removable attachment of the rotatable block 708 to the pivot pin 706. Hinged clasp 724 includes hinge portion 726 and attachment end 728. Hinge clasp 724 hingably rotates about the hinged portion 726. Attachment end 728 is removably attached to lip 730 of rotatable block 708.

Rotatable block 708 is preferably made of plastic. Housing extension 702 is preferably made of steel. However other materials and combinations of materials may be used.

Housing extension 702 includes jag 732. Jag 732 is a protrusion in the housing extension. Rotatable block 708 includes jag 734, which is a protrusion in the rotatable block 708. The purpose of jags 732 and 734 is twofold. First, the jags 732 and 734 provide the desired spacing between the first pinching surface and the second pinching surface 722. The desired distance between the first and second pinching surfaces which is set by the height of the jags 732 and 734 varies depending on the type and size extensible member used and should be engineered to prevent slippage of the extensible member when the window panel is in the tilted position without causing unnecessary damage to the extensible member. A distance between first pinching surface and second pinching surface of between 0.1 and 1.0 mm is preferred. More preferably, a distance between 0.2 and 0.4 mm is used. But of course these dimensions can vary outside these ranges, as they are heavily dependant on the type of extensible member used.

Jags 732 and 734 also perform the function of preventing the rotatable block 708 from being moved more than a small distance away from the pivot pin 706. If the rotatable block 708 begins to move away from the pivot pin 706 the jags 732 and 734 will contact each other to prevent further movement of the rotatable block 708.

Housing extension 702 includes hemispherically shaped bumps 736 and 738 on the first pinching surface 710. The hemispherical bumps 736 and 738 are approximately the same height as the jags 732 and 734. The bumps 736 and 738 provide a more discrete movement of the rotatable block 708 from an aligned position as shown in FIG. 15 to a nonaligned or tilted position as shown in FIG. 16 and vice versa. Because of the frictional fit between the hemispherical bumps 736 and 738 and the surface 740 of the rotatable block 708, the rotatable block 708 is prevented from too easily sliding from an aligned position to a nonaligned or tilted position. The bumps 736 and 738 help prevent pre-installation accidents wherein the rotatable block 708 may accidentally be moved from a nonaligned position to an aligned position causing release of a loaded spring.

Pulleys 742 and 744 form the pulleys for a block in the block and tackle (tackle not shown and extensible member not shown in relation to pulleys 742 and 744) the same as in block and tackle 418 disclosed earlier.

Figure 18:
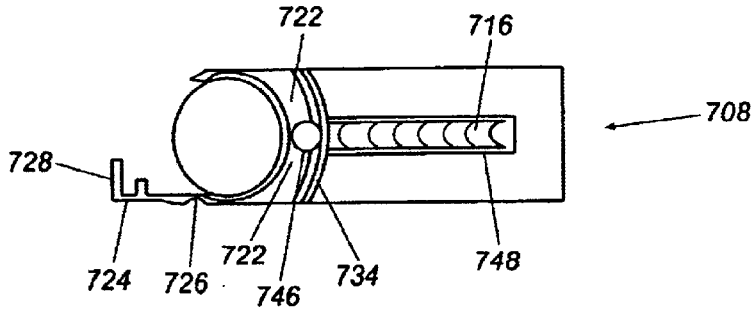
FIG. 18 is a side sectional view of a rotatable block of a balancer of a fourth embodiment in accordance with the principles of the invention.

FIG. 18 is a view of a rotatable block 708 taken along the lines 18—18 in FIG. 17. Rotatable block 708 defines an opening 748 for placement of pulley wheel 716. Rotatable block 708 also defines an opening 746 for passage of the extensible member 720 there through where the extensible member 720 would then pass through the opening 712 in the housing extension 702. Second pinching surface 722 can be seen adjacent to the opening 746. Jag 734 extends across the rotatable member 708 with a curvature.

Hinge clasp 728 can be seen in its open position wherein the rotatable member 708 is ready to be placed on the pivot pin 706.

Turning now to FIGS. 19-23, another embodiment of a latching mechanism for a balancer is disclosed. FIGS. 19-23 do not show the entire balancer but rather illustrate a portion of the housing extension and the latching mechanism that would be utilized by replacing the latching mechanism shown in FIGS. 5 and 6.

Figure 19:
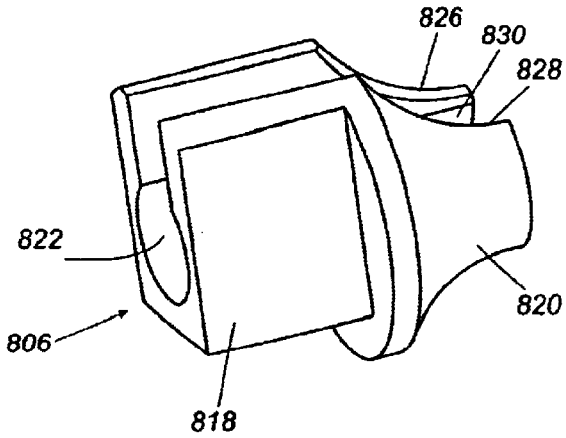
FIG. 19 is a perspective view of a rotatable pinching member of a balancer of a fifth embodiment in accordance with the principles of the invention.
Figure 20:
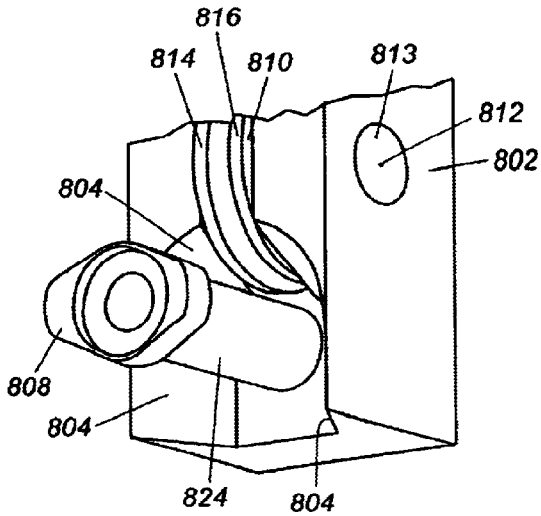
FIG. 20 is a perspective view of an end of a housing of a fifth embodiment in accordance with the principles of the invention.

FIGS. 19 and 20 illustrate two components of a balancer shown separately. Specifically FIG. 19 illustrates one embodiment of a rotatable pinching member 806 and FIG. 20 illustrates one embodiment of a housing extension 802 and related parts. The components in FIGS. 19 and 20 are combined, as they would be in normal operation in FIGS. 21-23.

Turning first to FIG. 20, a portion of housing extension 802 is provided. Housing extension 802 is configured to be secured to an elongated U-shaped housing as disclosed above with respect to embodiments shown in FIGS. 1-5. Housing extension 802 defines an opening along surface 804. The opening defined by surface 804 is generally cylindrical and is shaped for receipt of a rotatable pinching member 806 shown in FIG. 19. A pivot pin 808 is integrally secured to the housing extension 802 and passes through the opening defined by surface 804. Pivot pin 808 serves the same function with respect to sliding interaction with a jamb liner as described above with respect to the embodiments disclosed with respect to FIGS. 1-5. Pulley wheel 810 is rotatably secured to housing extension 802 along axis 812 by axle 813. Pulley wheel 810 includes a first circumferential edge portion 814 and a second circumferential edge portion 816. The circumferential edge portions 814 and 816 extend into the opening past the surface 804 so as to provide an appropriate pinching surface with the rotatable pinching member as will be described below.

Turning now to FIG. 19, rotatable pinching member 806 includes a pivot pin-engaging end 818 and a locking end 820 opposite the pivot pin engaging end 818.

A pivot pin-engaging end of a rotatable pinching member may be any shape or design capable of rotatably interacting with the pivot pin so that the rotatable pinching member can rotate about the pivot pin.

Pivot pin engaging end 818 is one embodiment of a pivot pin-engaging end. Pivot pin engaging end 818 defines a generally circular opening 822 that is approximately the same diameter as the post portion 824 of the pivot pin 808. Rotatable pinching member 806 is attached to the pivot pin 808 with the opening 822 surrounding the post portion 824 of the pivot pin 808. Locking end 820 is positioned in the opening of the housing extension 802 formed by surface 804.

A locking end of a rotatable pinching member is any surface shaped such that rotation of the locking end within a housing extension causes pinching of an extensible member against its associated pulley wheel. Locking end 820 is generally a truncated cone-shape with a first edge 826 and a second edge 828 forming a channel 830 there between.

Figure 21:
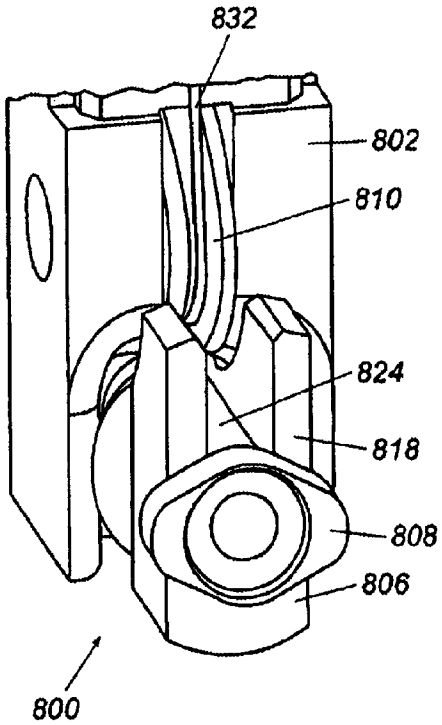
FIG. 21 is a perspective view of a latching mechanism of a balancer of a fifth embodiment in accordance with the principles of the invention.

FIG. 21 illustrates the positioning of the rotatable pinching member 806 with the housing extension 802 when the balancer 800 is in a vertical operating position. As can be seen, pivot-engaging end 818 receives pivot pin 808 around post portion 824. In the position shown in FIG. 21, channel 830 is aligned with the pulley wheel 810. The alignment of channel 830 with the pulley wheel 810 allows the extensible member 832 to pass around the pulley wheel 810 without interference from the rotatable pinching member 806.

Pivot pin engaging end 818 of the rotatable pinching member 806 is slidably received by a groove in a jamb liner such as groove 436 as described above with respect to FIG. 4. Therefore, as the balancer 800 is tilted with respect to its associated frame side member, the rotatable pinching member 806 rotates relative to the housing extension 802 and the pulley wheel 810. Since end 834 of extensible member 832 is attached to the frame side member, the extensible member 832 is pulled out of alignment with the pulley wheel 810 when the balancer is moved to a tilted position.

Figure 22:
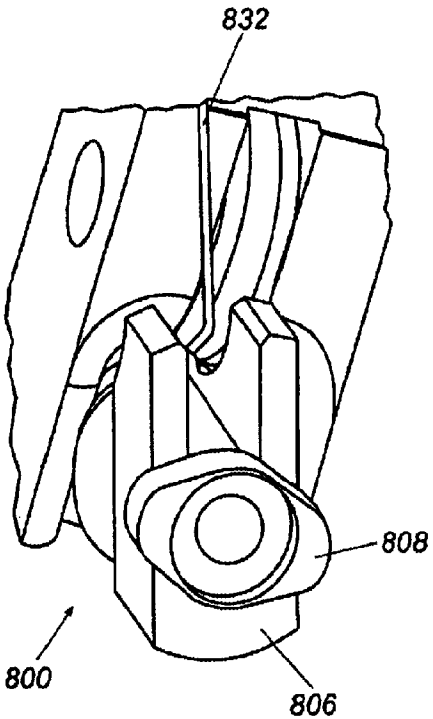
FIG. 22 is a perspective view of a latching mechanism of a balancer of a fifth embodiment in accordance with the principles of the invention.
Figure 23:
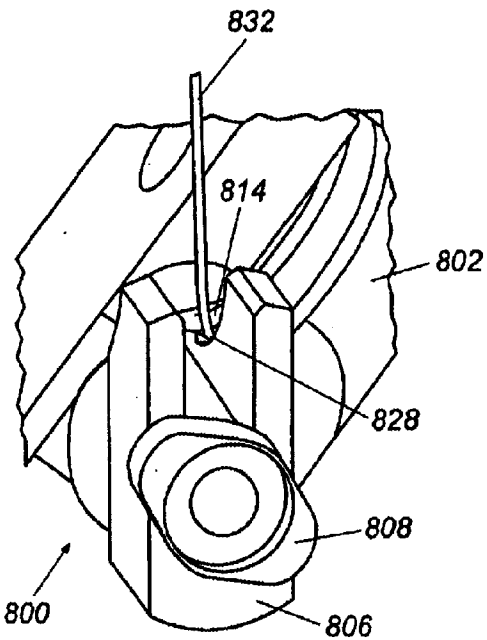
FIG. 23 is a perspective view of a latching mechanism of a balancer of a fifth embodiment in accordance with the principles of the invention.

FIG. 22 illustrates the positioning of the various components of the balancer 800 when the balancer 800 is moving from a vertical operating position to a tilted position. FIG. 23 illustrates the components of balancer 800 and their positions when the balancer 800 is in a tilted position. As can be seen in FIG. 23, rotation of the rotatable pinching member 806 relative to the housing extension 802 and the pulley wheel 810 results in the extensible member 832 becoming pinched or compressed between edge 828 and first circumferential edge portion 814 of pulley wheel 810. This pinching or compression of the extensible member 832 prevents longitudinal movement of the extensible member 832 when in the tilted position.

As with all of the embodiments of this invention, as the balancer 800 is moved back from a tilted position to a vertical operating position, the extensible member moves back from a pinched or compressed state to its normal operating state in which longitudinal movement is allowed.

It should be noted that if the rotatable pinching member 806 is designed with two edges such as edges 826 and 828, the balancer could be used for either side of a window panel. It should also be noted that in a preferred embodiment, edges 826 and 828 are chamfered as shown in FIG. 19. The chamfered edge allows for pinching of the extensible member without unnecessary abrasion or damage to the extensible member.

It should be noted that in one preferred embodiment of this invention, the balancer is operatively coupled to the window panel. The window panel may be a pane of glass or it may be an insulated glass assembly. The balancer may also be operatively coupled to the window panel through connection to a sash as has been illustrated above.

The foregoing description of preferred embodiments of the invention has been presented for the purposes of illustration and description. It is not intended to be exhaustive or to limit the invention to the precise form disclosed. It is intended that the scope of the invention be limited not by this detailed description, but rather by the claims appended hereto.

What is claimed is:

1. A hung window comprising:

(a) frame having a first vertical side member and an oppositely disposed second vertical side member wherein the first and second side members define a plane;

(b) a sash housing a window panel, the sash having a first side member and an oppositely disposed second side member, the sash having a first substantially vertical operating position in which the sash is slidably mounted in the frame with the first and second side members substantially parallel to the first and second frame side members, and the sash having a tilted position wherein the sash is positioned at an angle with respect to the plane of the frame; and (c) balancer comprising:

(i) housing secured to the first side of the sash wherein the housing comprises a pivot end about which the housing pivots when the sash rotates from the vertical operating position to the tilted position;

(ii) extensible member having a first end operatively coupled to the balancer and a second end operatively coupled to the first side member of the frame, wherein the balancer exerts a force on the sash through the extensible member in the direction substantially opposite the force of gravity when the sash is in the vertical operating position; and (iii) latching mechanism communicating with the balancer wherein the latching mechanism prevents the pivot end of the housing from moving vertically in the direction of gravity when the sash is in the tilted position.

2. The window of claim 1 wherein the housing comprises an elongated housing defining an elongated chamber, the housing comprising a second end opposite the pivot end, and wherein the balancer further comprises:

(a) biasing member for providing a biasing force, the biasing member having an anchored end and an opposite movable end, wherein the anchored end is connected to the second end of the housing and located in the elongated chamber;

(b) block and tackle located in the elongated chamber, the block secured to the housing near the pivot end, the tackle operatively coupled to the movable end of the biasing member, wherein the extensible member operatively connects the block to the tackle; and (c) pulley wheel operatively coupled to the housing substantially near the pivot end of the housing, the pulley wheel comprising a circumferential portion wherein the extensible member passes partially around the circumferential portion of the pulley wheel wherein the pulley wheel causes a change in direction of the extensible member of about 180 degrees.

3. The window of claim 1 wherein the biasing member is a spring.

4. The window of claim 1 comprising a second balancer secured to the side of the sash opposite the first balancer.

5. The window of claim 4 wherein a first sash groove is defined in the first sash side member and a second sash groove is defined in the second sash side member wherein the first balancer is mounted in the first sash groove and the second balancer is mounted in the second sash groove.

6. The window of claim 1 wherein the housing comprises an elongated housing defining an elongated chamber, the elongated housing having a second end wherein the balancer further comprises:

(a) pulley wheel operatively coupled to the housing substantially near the pivot end of the housing, the pulley wheel including a first and second circumferential edge portion defining a groove there between;

(b) biasing member located in the elongated chamber for providing a biasing force, the biasing member having an anchored end and an oppositely disposed movable end, wherein the anchored end of the biasing member is connected to the second end of the housing;

(c) block and tackle located in the elongated chamber, wherein the tackle is operatively coupled to the movable end of the biasing member and the block is operatively coupled to the pivot end of the housing, wherein the extensible member operatively connects the block to the tackle, wherein the extensible member has a first end, second end and central portion, wherein the first end of the extensible member is operatively coupled to the block and tackle, the central portion connects the block to the tackle and the central portion is operatively coupled to the pulley wheel wherein the central portion has a first position relative to the pulley wheel in which the central portion of the extensible member is in the groove of the pulley wheel, the extensible member being in the first position when the sash is in the vertical position, wherein the second end of the extensible member is anchored to the first frame side member, wherein the extensible member is extensible when in the first position;

(d) pinching member adjacent one of the first and second edge portions of the pulley wheel wherein the extensible member has a second position relative to the pulley wheel in which the extensible member has a second position relative to the pulley wheel in which the extensible member is positioned between the pinching member and one of the first and second edge portions wherein the extensible member is not extensible when in the second position, and the extensible member is in the second position when the sash is in the tilted position.

7. The window of claim 6 further comprising a jamb liner substantially parallel to and operatively coupled to the first frame side member, the jamb liner having a front face, and the front face having an elongate channel, and wherein a pivot pin that slides in the elongate channel is operatively coupled to the balancer wherein the sash can be pivoted at the pivot pin from the vertical position to the tilted position, and wherein the extensible member moves from the first position to the second position when the sash is moved from the vertical position to the tilted position.

8. The hung window of claim 1 wherein the latching mechanism comprises:

(a) pulley wheel rotatably connected to the pivot end of the housing, the pulley wheel comprising a circumferential portion wherein the extensible member passes partially around the circumferential portion of the pulley wheel;

(b) brake comprising a braking surface adjacent the extensible member and the circumferential portion of the pulley wheel wherein the pulley wheel and brake have a first relative position wherein a space is provided between the braking surface and the extensible member, and wherein the pulley wheel and brake have a second relative position wherein the extensible member is pinched between the circumferential portion and the braking surface; and (c) rotatable cam member comprising a camming surface, wherein the rotatable cam member operatively interacts with the first frame side member such that movement of the sash from the vertical operating position to the tilted position causes rotation of the cam member wherein movement of the sash from the vertical operating position to the titled position results in the camming surface contacting one of the pulley wheel and brake wherein the pulley wheel and brake are moved from the first relative position to the second relative position.

9. The hung window of claim 1 wherein the latching mechanism comprises:

(a) pulley wheel rotatably connected to the pivot end of the housing, the pulley wheel comprising a circumferential portion wherein the extensible member passes partially around the circumferential portion of the pulley wheel;

(b) brake having an unlocked position and a locked position relative to the extensible member, the brake comprising:

(i) braking surface wherein the braking surface is adjacent but not in forceful contact with the extensible member when the brake is in the unlocked position, and the braking surface is in contact with the extensible member such as to compress the extensible member between the circumferential portion of the pulley wheel and the braking surface to prevent longitudinal movement of the extensible member when the brake is in the locked position; and (ii) force receiving surface opposite the braking surface; and (c) rotatable cam member comprising a camming surface, wherein the rotatable cain member operatively interacts with the first frame side member such that movement of the sash from the vertical operating position to the tilted position causes rotation of the cam member wherein movement of the sash from the vertical operating position to the tilted position results in the camming surface contacting the force receiving surface of the brake forcing the brake into the locked position.

10. The hung window of claim 9 wherein the brake comprises a rotational end and an oppositely disposed braking end, wherein the braking surface and the force receiving surface are on the braking end, and the rotational end is in pivotal engagement with the housing such that the brake rotates around the rotational end when the camming surface of the cam member contacts the force receiving surface of the brake.

11. The hung window of claim 9 wherein the brake comprises an anchored end and an oppositely disposed braking end, wherein the braking surface and the force receiving surface are on the braking end, and the anchored end is nonpivotally anchored to the housing such that the brake bends in the direction of the pulley wheel when the camming surface of the cam member contacts the force receiving surface of the brake.

12. The hung window of claim 9 wherein the cam member comprises:

(a) center axis wherein the cam member rotates around the center axis;

(b) circular section comprising a circular outer edge wherein the distance from the center axis to the circular outer edge is constant along the circular outer edge; and (c) recessed edge forming a notch wherein the distance from the center axis to the recessed edge is less than the distance from the center axis to the circular outer edge and is wherein the camming surface comprises the recessed edge.

13. The hung window of claim 1 wherein the housing further comprises a first pinching surface at the pivot point end, wherein the pinching surface defines an opening and wherein the latching mechanism further comprises:

(a) rotatable block rotatably coupled to the pivot end of the housing wherein the rotatable block comprises a second pinching surface substantially parallel to the first frame side member such that movement of the sash from the vertical operating position to the tilted position causes rotation of the rotatable block relative to the housing along an axis perpendicular to the first and second pinching surfaces; and (b) pulley wheel rotatably coupled to the rotatable block, wherein the pulley wheel comprises a circumferential portion, wherein the extensible member passes through the opening in the housing and partially around the circumferential portion of the pulley wheel, wherein the opening in the housing and the circumferential portion of the pulley wheel are aligned when the sash is in its vertical operating position, and the opening in the housing and the circumferential portion of the pulley wheel are out of alignment when the sash is moved into the tilted position wherein the extensible member is pinched between the first pinching surface and the second pinching surface wherein longitudinal movement of the extensible member is prevented when the sash is moved to the tilted position.

14. The hung window according to claim 13 wherein the rotatable block comprises plastic.

15. The hung window according to claim 13 wherein the balancer further comprises a pivot pin connected to the pivot end of the housing wherein the pivot pin is configured for sliding interaction with the frame side member adjacent the balancer and wherein the rotatable block is rotatably coupled to the pivot pin to provide rotation of the rotatable block relative to the housing.

16. The hung window according to claim 1 wherein the housing is configured to further define an opening, wherein the balancer further comprises a pivot pin connected to the pivot end of the housing wherein the pivot pin is configured for sliding interaction with the first frame side member, and wherein the latching mechanism further comprises:

(a) pulley wheel rotatably coupled to the pivot end of the housing, wherein the pulley wheel comprises a circumferential edge portion extending into the opening defined by the housing; and (b) rotatable pinching member rotatably coupled to the pivot pin, the rotatable pinching member operatively interacting with the first frame side member such that movement of the sash from the vertical operating position to the tilted position causes rotation of the rotatable pinching member relative to the housing along an axis parallel to the pivot pin, wherein the rotatable pinching member comprises:

(i) pivot pin engaging end defining a pivot pin receiving opening for receiving the pivot pin wherein the rotatable pinching member operatively interacts with the frame side member adjacent the balancer to pivot around the pivot pin when the sash is moved from the vertical operating position to the tilted position;

(ii) locking end opposite the pivot pin engaging end wherein the locking end is positioned in the housing opening, wherein the locking end includes a first edge and a second edge wherein the first and second edges define a channel therebetween, wherein when the sash is in the vertical operating position the channel is aligned with the pulley wheel to allow longitudinal movement of the extensible member through the channel, and when the sash is in the tilted position the channel is not aligned with the pulley wheel wherein the extensible member is pinched between the circumferential edge portion of the pulley wheel and one of the first and second edges of the locking end of the rotatable pinching member wherein longitudinal movement of the extensible member is prevented.

17. The hung window according to claim 16 wherein one of the first and second edges of the rotatable pinching member is chamfered.

18. The hung window of claim 1 wherein the latching mechanism prevents longitudinal movement of the extensible member when the sash is tilted.

* * * * *